US007753802B2

(12) United States Patent
McCormick

(10) Patent No.: US 7,753,802 B2
(45) Date of Patent: Jul. 13, 2010

(54) BILLIARD TABLE WITH MOVABLE APRON THAT CONCEALS/EXPOSES A STORAGE COMPARTMENT

(75) Inventor: William R. McCormick, Pleasant Prairie, WI (US)

(73) Assignee: Brunswick Bowling & Billiards Corporation, Lake Forest, IL (US)

( * ) Notice: Subject to any disclaimer, the term of this patent is extended or adjusted under 35 U.S.C. 154(b) by 71 days.

(21) Appl. No.: 11/903,826

(22) Filed: Sep. 24, 2007

(65) Prior Publication Data

US 2009/0082119 A1 Mar. 26, 2009

(51) Int. Cl.
*A63D 15/06* (2006.01)
*A63D 15/00* (2006.01)
*A63D 13/00* (2006.01)

(52) U.S. Cl. ..... 473/31; 473/8; 473/13; 473/4; 473/33

(58) Field of Classification Search ..... 473/31, 473/32, 33, 1, 6, 14, 18
See application file for complete search history.

(56) References Cited

U.S. PATENT DOCUMENTS

| | | | | | |
|---|---|---|---|---|---|
| 156,389 | A | | 10/1874 | Stiles | |
| 572,688 | A | | 12/1896 | Seifert | |
| 1,540,316 | A | * | 6/1925 | Clement | 473/11 |
| 1,568,154 | A | | 1/1926 | Hannon et al. | |
| D85,561 | S | | 11/1931 | Toce | |
| 2,008,613 | A | | 7/1935 | Hernes | |
| 2,174,613 | A | | 10/1939 | Blaschke | |
| 2,572,333 | A | * | 10/1951 | Greitzer | 108/90 |
| 3,156,467 | A | * | 11/1964 | Rucker | 273/126 R |
| 3,319,958 | A | * | 5/1967 | Bender | 473/15 |
| D215,220 | S | | 9/1969 | Eide | |
| 3,881,727 | A | | 5/1975 | Olson | |
| 3,941,378 | A | * | 3/1976 | Bagley | 473/10 |
| D257,469 | S | | 10/1980 | Moore | |
| D257,684 | S | | 12/1980 | Moore | |
| 4,345,758 | A | * | 8/1982 | Kempf | 473/475 |
| 4,474,374 | A | | 10/1984 | Lewis et al. | |
| D332,293 | S | | 1/1993 | Powers | |
| D348,916 | S | | 7/1994 | Powers | |
| D408,487 | S | | 4/1999 | McCormick et al. | |
| D408,488 | S | | 4/1999 | McCormick et al. | |
| D418,185 | S | | 12/1999 | McCormick et al. | |

(Continued)

OTHER PUBLICATIONS

"Gold Crown IV," Brunswick Billiards, Inc., http://www.brunswickbilliards.com/brunswick_collection/tables/competition/gold_crown_iv_room.html, 1 page, 2007.

(Continued)

*Primary Examiner*—Mitra Aryanpour
(74) *Attorney, Agent, or Firm*—Brinks Hofer Gilson & Lione

(57) ABSTRACT

A billiard table with a movable apron that conceals/exposes a storage compartment is provided. In one embodiment, a billiard table is presented comprising a playing surface, a rail positioned along an edge of the playing surface, a storage compartment, and an apron movable between a first position in which the apron conceals the storage compartment and a second position in which the apron exposes the storage compartment. In another embodiment, a billiard table is presented comprising a playing surface, a rail, and a storage compartment that provides a mechanical connection between the playing surface and the rail.

9 Claims, 4 Drawing Sheets

U.S. PATENT DOCUMENTS

| | | | | |
|---|---|---|---|---|
| D473,278 | S | 4/2003 | McCormick et al. | |
| 6,644,662 | B1 * | 11/2003 | Cao et al. | 473/20 |
| D489,784 | S | 5/2004 | Foley | |
| D491,245 | S | 6/2004 | Newhouse | |
| D494,241 | S | 8/2004 | Moore, Sr. | |
| D494,242 | S | 8/2004 | McCormick | |
| D495,766 | S | 9/2004 | Moore, Sr. | |
| D500,543 | S | 1/2005 | Stein | |
| D505,173 | S | 5/2005 | Foley | |
| D510,824 | S | 10/2005 | Moore, Sr. | |
| 2007/0155519 | A1 * | 7/2007 | Panzica | 473/1 |

OTHER PUBLICATIONS

"Manchester II, Camden II, Pocket Billiard Table Installation Manual," Brunswick Billiards, Inc., 11 page, 2000.

"Gold Crown," Brunswick Billiards, Inc., 1 page, 2004.

"Gold Crown IV Features," Brunswick Billiards, Inc., http://www.brunswickbilliards.com/brunswick_collection/tables/competition/gold_crown_iv_features.html, 1 page, 2007.

"Gold Crown IV," Brunswick Billiards, Inc., http://www.brunswickbilliards.com/brunswick_collection/tables/competition/gold_crown_iv.html, 1 page, 2007.

* cited by examiner

BILLIARD TABLE WITH MOVABLE APRON THAT CONCEALS/EXPOSES A STORAGE COMPARTMENT

BACKGROUND

Billiard tables may be provided with a storage compartment for storage of billiard balls or other billiard equipment. Such storage compartments are usually below the apron and in the space between the legs of the table. Billiard tables are often designed with appealing aesthetic qualities similar to other pieces of home furniture. Unfortunately, an exposed storage compartment may detract from the aesthetically-pleasing design of the billiard table.

SUMMARY

The present invention is defined by the claims, and nothing in this section should be taken as a limitation on those claims.

By way of introduction, the embodiments described below provide a billiard table with a movable apron that conceals/exposes a storage compartment. In one embodiment, a billiard table is presented comprising a playing surface, a rail positioned along an edge of the playing surface, a storage compartment, and an apron movable between a first position in which the apron conceals the storage compartment and a second position in which the apron exposes the storage compartment. In another embodiment, a billiard table is presented comprising a playing surface, a rail, and a storage compartment that provides a mechanical connection between the playing surface and the rail. Other embodiments are disclosed, and each of the embodiments can be used alone or together in combination.

The embodiments will now be described with reference to the attached drawings.

DETAILED DESCRIPTION OF THE PRESENTLY PREFERRED EMBODIMENTS

Figure 1:
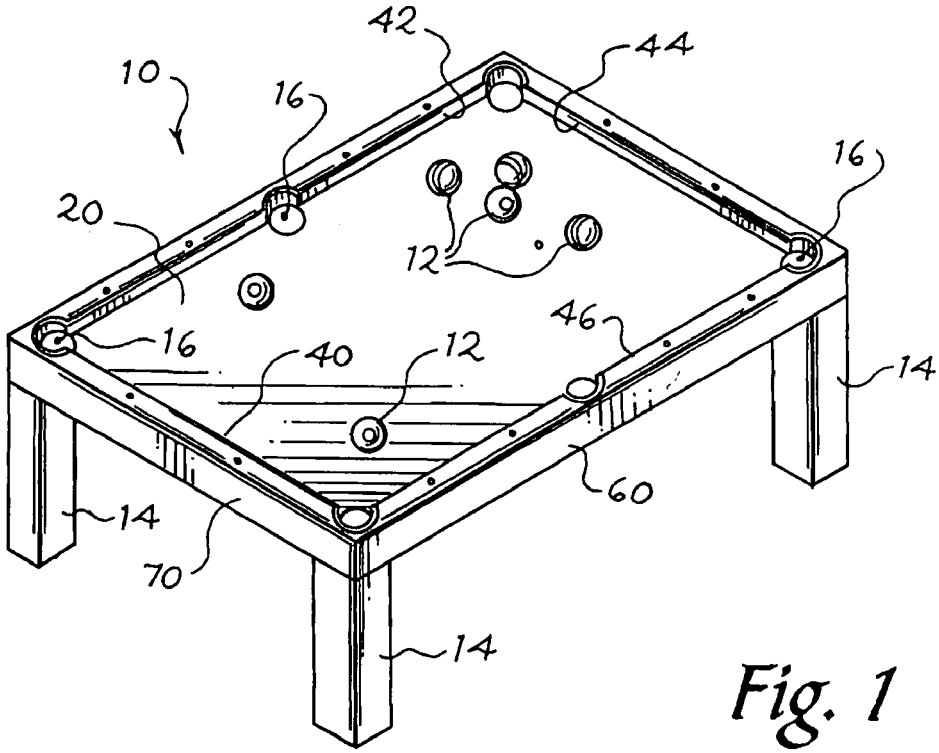
FIG. 1 is a view of a billiard table of an embodiment with a storage compartment substantially blocked by an apron in a first position.

By way of overview, the embodiments described below relate to a billiard table with a movable apron that conceals a storage compartment when the apron is in a first position and exposes the storage compartment when the apron is in a second position. By selectively concealing the storage compartment, the apron allows the billiard table to retain an aesthetically-pleasing design, unlike prior billiard tables in which a permanently-exposed storage compartment can detract from the aesthetic quality of the table.

Turning now to the drawings, FIGS. 1-6 show a billiard (or pool) table 10 of an embodiment. The billiard table 10 comprises a playing surface 20, a plurality of rails 40, 42, 44, 46 adjacent the playing surface 20, a plurality of aprons 60, 70 (and two others not shown in these views), and a plurality of legs 14. As used herein, the term "adjacent to" can mean directly adjacent to or indirectly adjacent to, as when one or more intervening components (shown or not shown herein) are between the two components that are adjacent to one another. Similarly, the phrase "coupled with" can be directly coupled with or indirectly coupled with through one or more components named or unnamed herein. In this embodiment, the billiard table 10 also includes a plurality of pockets 16 that are configured to receive billiard balls during the course of a billiard game. However, some alternate billiard tables may not include pockets.

The playing surface 20 is preferably a solid, flat, elongated member that is horizontally disposed on the table 10 to provide a suitable surface for billiard balls 12 to roll thereupon during a billiard game. The playing surface 20 can take any suitable form including, but not limited to, slate, plastic, or wood. The bottom surface 25 of the playing surface 20 may be affixed with a plurality of strips 26 (see FIG. 5) that are provided to accept fasteners used to affix several of the aprons to the playing surface 20, as will be discussed in more detail below. Additionally, a layer of fabric, such as felt 28, is disposed and stretched over the top surface 21 and the plurality of side surfaces 24 of the playing surface 20 to provide a smooth and aesthetically-pleasing visible portion of the playing surface 20. The felt 28 can be fixed to the strips 26 around the perimeter of the playing surface 20 with a plurality of fasteners. The edges of the playing surface 20 may be provided with a plurality of holes 29 to receive a plurality of posts 59 that extend from the plurality of rails 40, 42, 44, 46 to provide a mechanical connection between the playing surface 20 and the plurality of rails 40, 42, 44, 46.

The plurality of rails 40, 42, 44, 46 provide side surfaces of the billiard table 10 when mounted above the playing surface 20. In this way, the plurality of rails 40, 42, 44, 46 define a substantially-enclosed geometry that serves as the playing area of the billiard table 10. In some embodiments, the plurality of rails 40, 42, 44, 46 include an inner edge 41 (see FIG. 5) that may be formed from a slightly compressible material, or a cushion, that is oriented to be contacted by the billiard balls 12 as they reach an edge of the playing surface, which allows the billiard balls to carom off the rails 40, 42, 44, 46. As mentioned above, the plurality of rails 40, 42, 44, 46 additionally receive a respective plurality of posts 59 that extend from the bottom surface of each rail 40, 42, 44, 46 and are located to be inserted within the plurality of holes 29 on the playing surface 20. Once the plurality of rails 40, 42, 44, 46 are disposed on the playing surface 20 and the plurality of posts 59 are inserted within the plurality of holes 29 on the playing surface 20, the plurality of posts 59 may be retained through the playing surface 20 with nuts or similar fastening structures. It should be noted that, although shown as single pieces in the drawings, one or more of the plurality of rails 40, 42, 44, 46 can be made up of a plurality of components connected together (e.g., in an end-to-end fashion). For example, rail 46 can be made up of two pieces that join at the side pocket. Also, as will be described in more detail below, each of the plurality of rails 40, 42, 44, 46 in this embodiment includes a respectively groove 50 that is longitudinally defined on the bottom surface of each rail 40, 42, 44, 46 (see FIG. 4). The grooves 50 are preferably defined at constant distances from the inner edge 41 on all of the rails 40, 42, 44, 46 of the billiard table 10.

Figure 2:
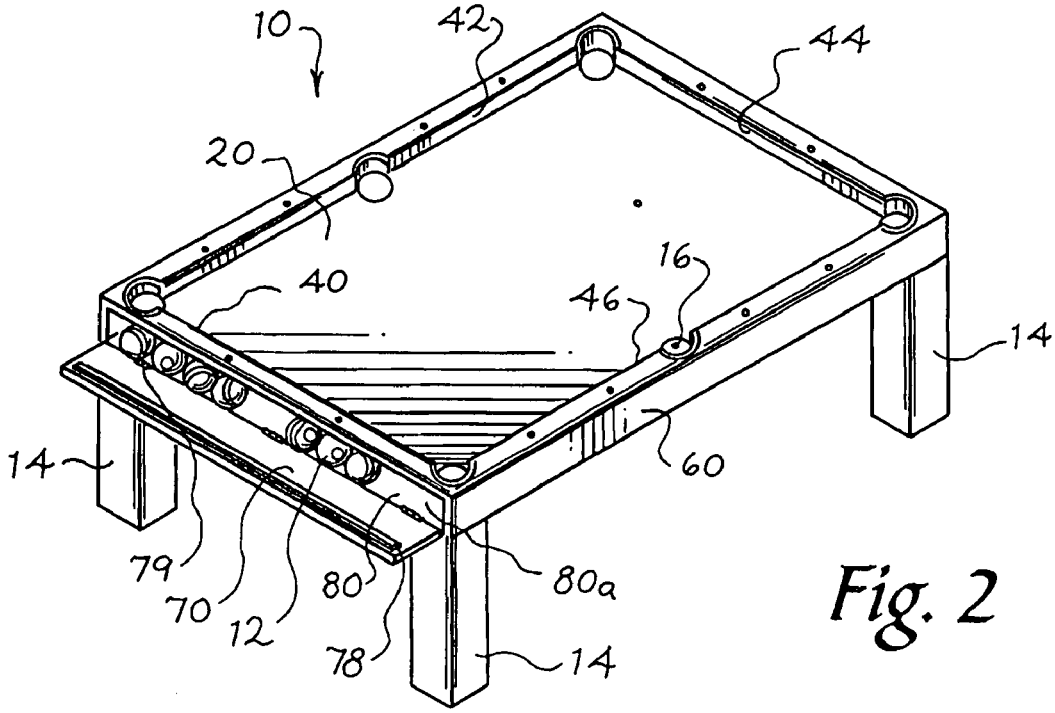
FIG. 2 is a view of the billiard table of an embodiment with the apron moved to a second position to allow access to a storage compartment.

As mentioned above, the billiard table 10 also includes a plurality of aprons 60, 70. In general, an apron is a component, usually wood, between the plurality of rails 40, 42, 44, 46 and the legs 14 that covers the edges of the playing surface 20, felt 28, and table frame to provide a finished look. As will be described in more detail below, in this embodiment, the billiard table 10 contains a storage compartment, and one of the aprons (in this embodiment, apron 70) is movable between a first position in which the apron 70 conceals the storage compartment (as shown in FIG. 1) and a second position in which the apron 70 exposes the storage compartment (as shown in FIG. 2). Before discussing this apron 70, a description of the other, non-movable aprons will be presented.

Figure 6:
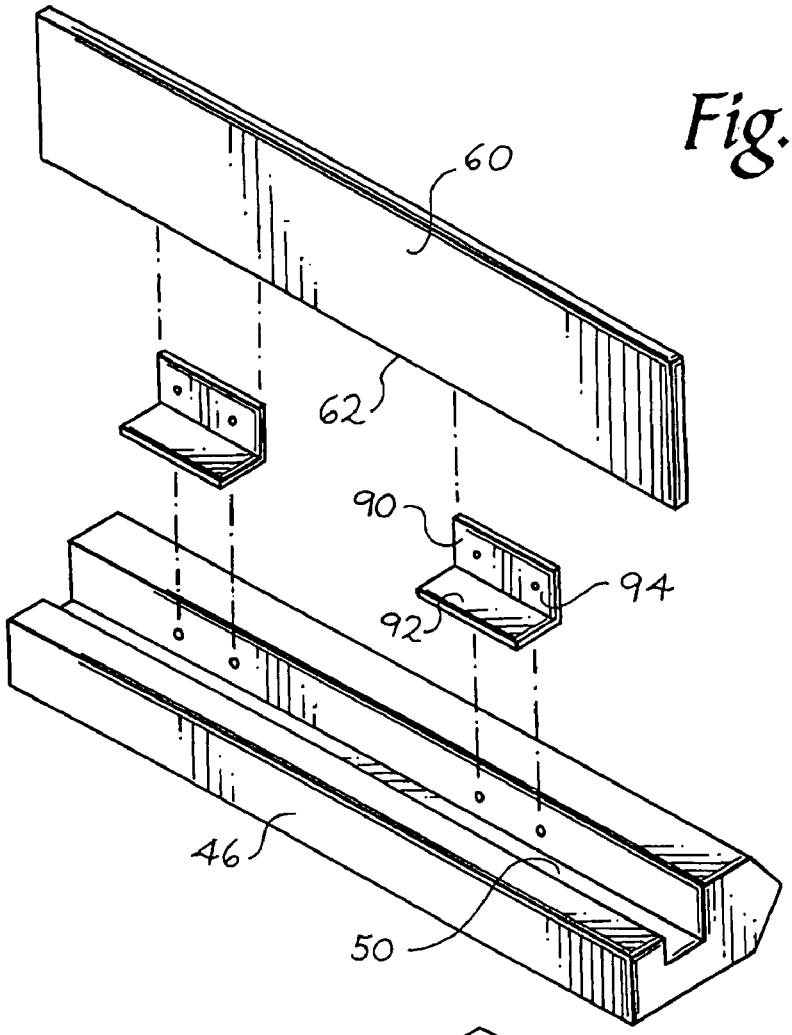
FIG. 6 is an exploded view of an apron and a rail of a billiard table of an embodiment.

During assembly of the billiard table 10, rails 42, 44, 46 are mechanically connected to the non-movable aprons (apron 60 and the other aprons not shown in the drawings). The connection used in this embodiment is shown in FIG. 6 using apron 60 and rail 46 as an example. In this embodiment, in connecting the apron 60 to the rail 46, a first leg 92 of a bracket 90 is inserted into a groove 50 defined on the bottom surface of the rail 46. The bracket 90 includes a second leg 94 that extends at a substantially perpendicular angle to the first leg 92 of the bracket 90. The second leg 94 provides a fixation surface for connecting the apron 60 to the rail 46 such that a first side edge 62 of the apron 60 extends into the groove 50 of the rail 46 and the opposite second side edge 64 of the apron 60 extends below the bottom surface of the rail 46 in parallel to the rail 46. In embodiments in which the billiard table 10 includes six pockets 16 and six rails (one pocket at each of the four corners of the playing surface 20, and a pocket in the middle of each long side of the playing surface 20), the apron 60 and the other aprons are connected to five of the six rails 40 prior to assembly with the playing surface 20.

Figure 3:
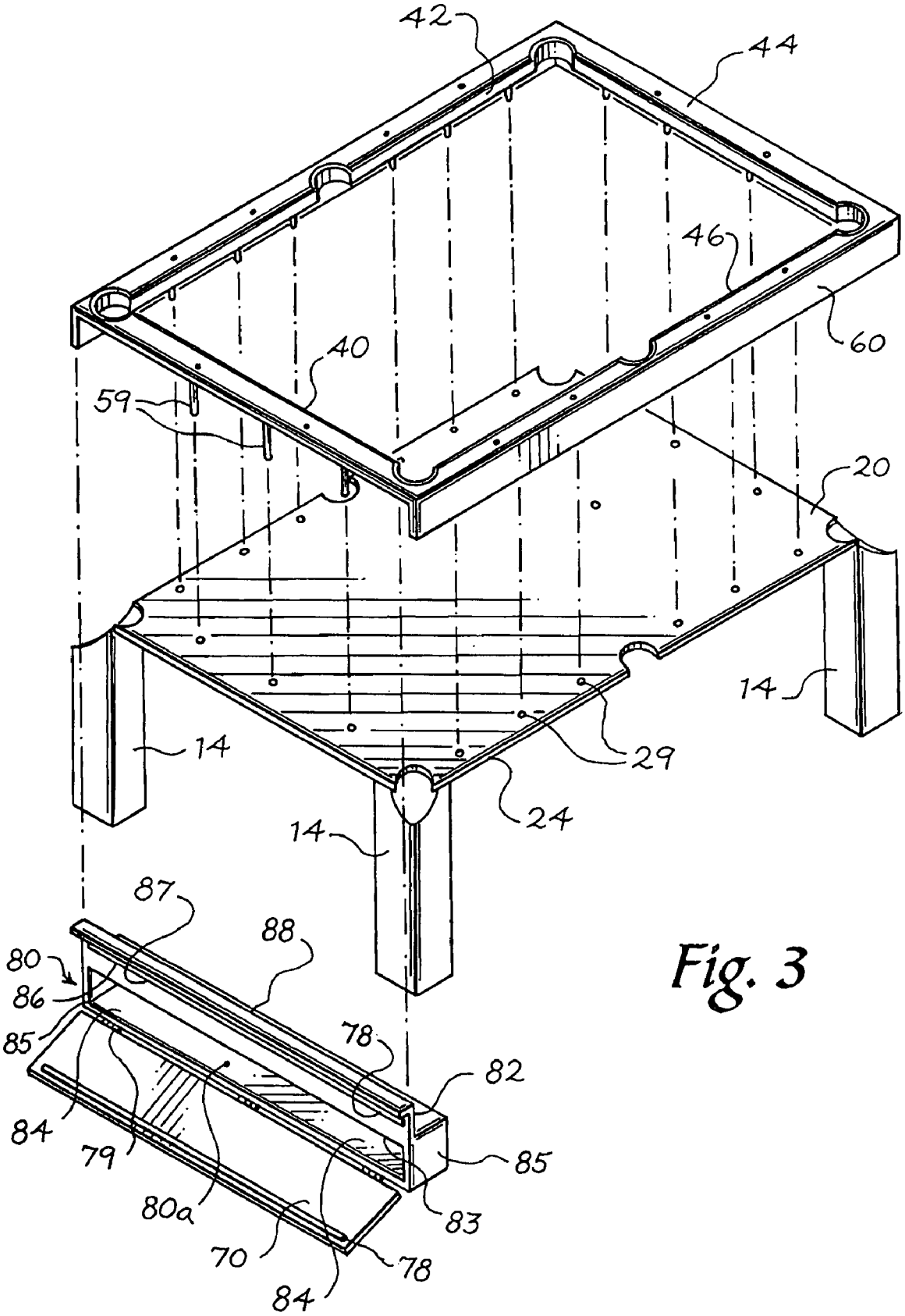
FIG. 3 is an exploded view of a billiard table of an embodiment.
Figure 4:
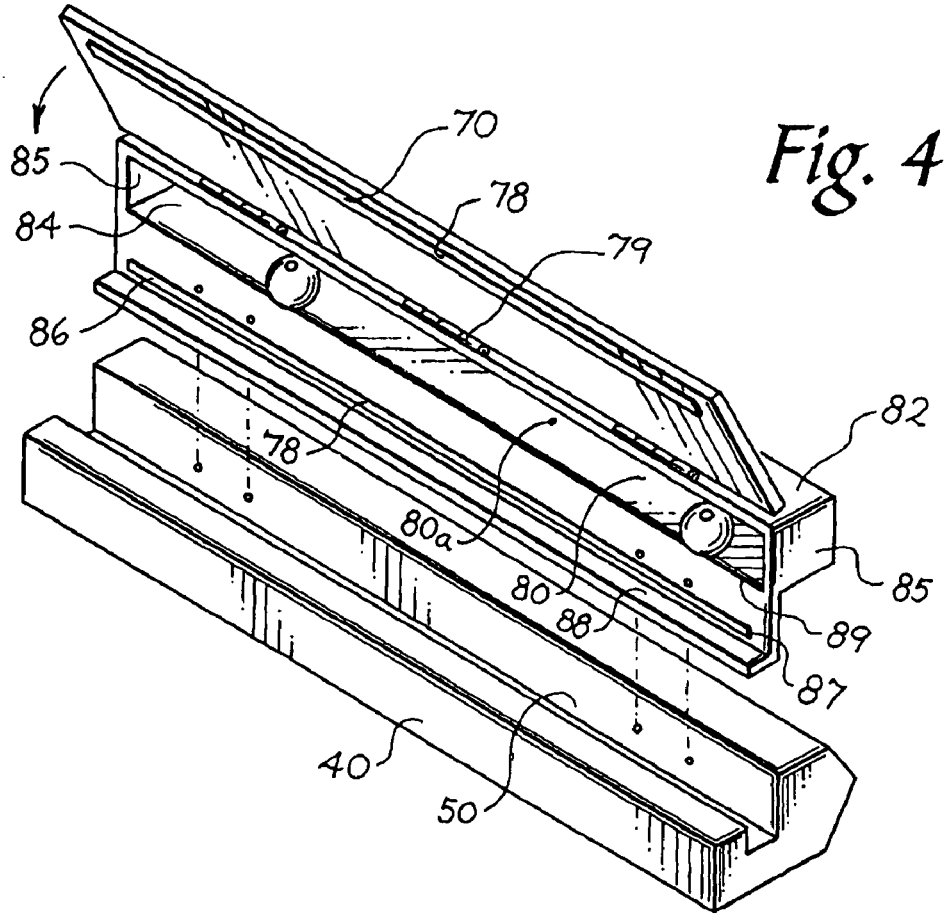
FIG. 4 is an exploded view of a rail and a storage compartment of a billiard table of an embodiment.
Figure 5:
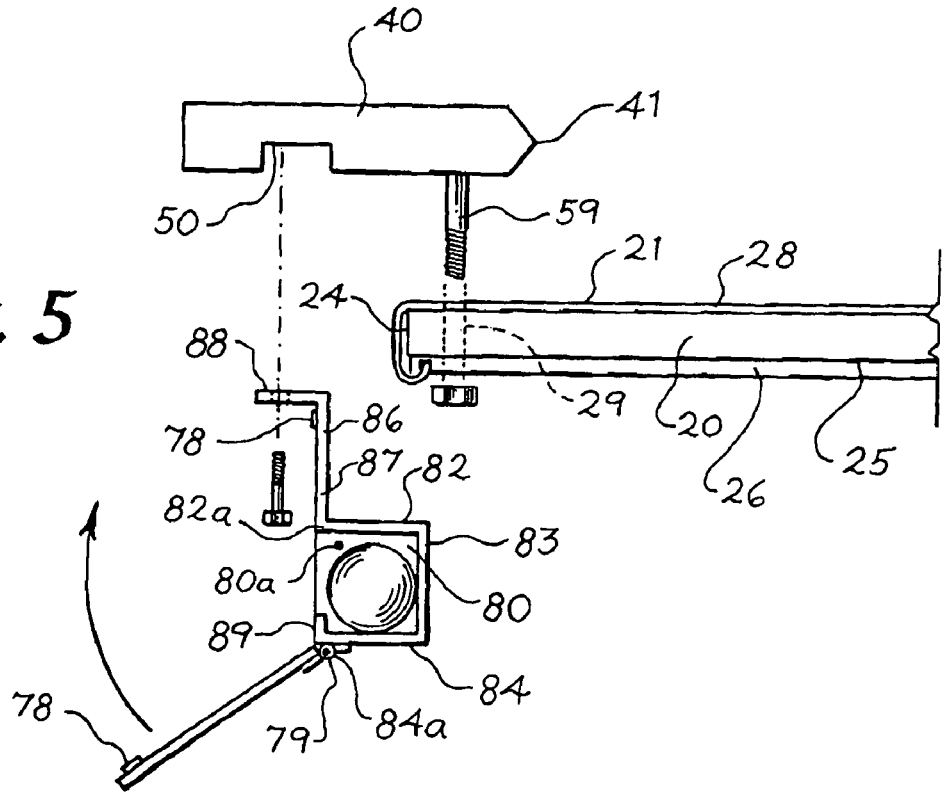
FIG. 5 is a side exploded view of a rail, playing surface, and storage compartment of a billiard table of an embodiment.
Figure 7:
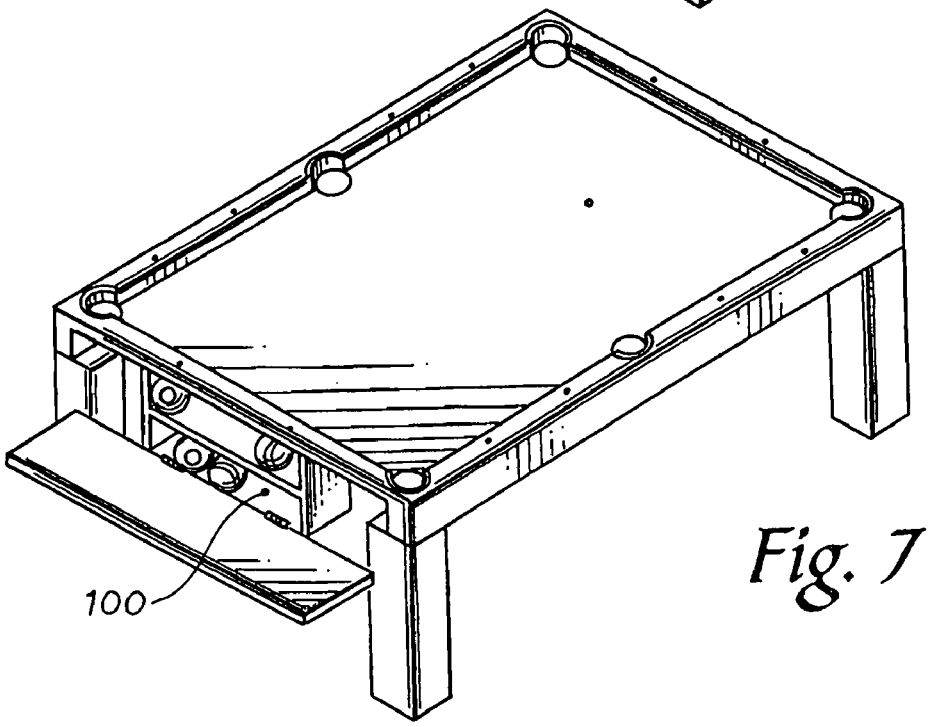
FIG. 7 is a view of a billiard table of an embodiment.

Turning now to the storage compartment 80 and movable apron 70, the storage compartment 80 in this embodiment is a relatively box-like structure with a top wall/surface 82, a rear wall/back surface 83, two side walls 85, and a bottom wall/bottom surface 84 (see FIGS. 3 and 5). The storage compartment 80 includes an open front surface to allow access within the internal volume of the storage compartment 80. The internal volume 80*a* of the storage compartment 80 is sized to receive a billiard ball therein, and preferably the storage compartment 80 is of a suitable length to receive all of the billiard balls used for a typical billiard game. The storage compartment 80 may include a small ledge 89 (see FIG. 5) that extends upward at the front end of the bottom wall 84 to prevent billiard balls from rolling out of the storage compartment 80 through the open surface. The storage compartment 80 can have other shapes and configurations. For example, instead of being formed as a single level where all of the billiard balls are disposed in a single line within the storage compartment 80, the storage compartment can be formed with two or more levels 100 (see FIG. 7) to make the open portion of the storage compartment more longitudinally compact. Also, the storage compartment 80 can be located in any suitable location on the billiard table 10. For example, while the storage compartment 80 is shown adjacent to apron 70 in this embodiment, in other embodiments, the storage compartment can be located at the other end and/or at one or both sides of the billiard table 10. Also, the storage compartment 80 does not necessarily need to be able to store billiard balls. For example, the storage compartment 80 can be sized to store chalk or cue sticks, for example, instead of or in addition to billiard balls.

In one embodiment, the storage compartment 80 includes a bracket 86 that is fixedly connected to, or integrally or monolithically formed with, the top surface 82 of the storage compartment 80. The bracket 86 includes a first leg 87 that extends upward from the top surface 82 of the storage compartment 80. In some embodiments, as shown in FIG. 5, the first leg 87 is planar with the front edges 82*a*, 84*a* of both the top and bottom surfaces 82, 84, respectively. In other embodiments, the first leg 87 may extend upward from and be connected to either the top surface 82 or one or both of the side surfaces 85 of the storage compartment 80. In some embodiments, the first leg 87 of the bracket 86 extends perpendicularly to the top surface 82 of the storage compartment 80, while in other embodiments, the first leg may extend at other acute or obtuse angles from the top surface 82.

The bracket 86 further includes a second leg 88 that is connected to the extended end of the first leg 87 and is sized to be received within the groove 50 of rail 40. The second leg 88 may be fixedly connected to the groove 50 and rail 40 with a plurality of fasteners. With this connection, the storage compartment 80 is fixedly retained to rail 40 and hangs directly below rail 40. This provides additional mechanical support to the storage compartment 80. The top surface 82 of the storage compartment 80 may be mechanically connected to the strips 26 at on the bottom surface 25 of the playing surface 20. Accordingly, the storage compartment 80 provides a (direct or indirect) mechanical connection between both rails 40 and the playing surface 20 by virtue of the mechanical connection between both members and the storage compartment 80.

Further, the storage compartment 80 (and specifically the first leg 87 of the bracket 86 (discussed above) and the back surface 83 of the storage compartment 80) substantially block the side and bottom surfaces 24, 25 of the playing surface 20, which are not generally designed to be aesthetic. Moreover, the storage compartment 80 protects the playing surface 20 and specifically the felt 28 wrapped therearound from being snagged or torn by foreign objects upon contact. Because the stretched side and bottom surfaces of the felt 28 around the playing surface 20 are enclosed by the storage compartment 80, the risk of potential damage to the felt and the playing surface is less than with designs where these members are exposed.

As best shown in FIGS. 2-5, in this embodiment, the storage compartment 80 also receives apron 70. As discussed above, apron 70 is movable between a first position in which the apron 70 conceals the storage compartment 80 (as shown in FIG. 1) and a second position in which the apron 70 exposes the storage compartment 80 (as shown in FIG. 2). It should be understood that apron 70 can be movable in any suitable fashion (e.g., pivotable, slideable, etc. or even completely removable). Without intending to be a limitation on the claims, in this particular embodiment, apron 70 is pivotably connected to the front edge 84*a* of the bottom surface 84 of the storage compartment 80 with a hinge 79 or similar member. Accordingly, apron 70 is pivotable about the storage compartment 80 between a first position (FIG. 2) where apron 70 hangs downward from the storage compartment 80 allowing access to the internal volume of the storage compartment 80, and a second position (FIG. 1) where apron 70 obstructs access to the internal volume 80*a* of the storage compartment 80. Apron 70 may contact the front edge 82*a* of the top surface 82 and/or the first leg 87 of the bracket 86 of the storage compartment 80 when in the second position. In some embodiments, apron 70 is oriented with respect to the rail 40 that receives the storage compartment 80 therebelow in the same manner as the remaining aprons 60, etc. that are rigidly mounted to rails 42, 44, 46, as observed from the outer surfaces of the billiard table 10.

The storage compartment 80 is connected to the remaining rail (rail 40) that did not receive an apron. The bracket 86 is disposed with respect to the remaining rail 40 such that the second leg 88 is positioned within the groove 50 on the bottom side of the rail 40. The second leg 88 of the bracket 86 is mechanically connected to the rail 40 with a plurality of fasteners. Next, a plurality of fasteners are inserted through the top surface 82 of the storage compartment 80 into the strips 26 on the playing surface 20 to mechanically connect the storage compartment 80 to both the rails 40 and the playing surface 20, and to additionally block the side and bottom surfaces of the playing surface 20 from view.

The apron 70 may be rotatably mounted to the front edge 84*a* of the bottom surface 84 of the storage compartment 80 with a hinge or similar member. Apron 70 is mounted such that apron 70 is oriented similarly to apron 60 when in a closed position. Apron 70 may be removably fixed to the storage compartment 80 in the closed position with a plurality of mechanical structures. For example, in the embodiment shown in FIG. 3, corresponding magnets 78 on the apron 70 and the storage compartment 80 may be provided. Alternatively, a magnet may be fixed on the apron and removably retained in contact with the front edge of the top surface and/or the first leg of the bracket in embodiments where the storage compartment is manufactured from a ferrous material. In still other embodiments, the apron is removably received in the closed position with a detent provided on one of the storage compartment and apron, and a corresponding recess to receive the detent provided on the other of the storage compartment and apron. In some embodiments, apron 70 may be retained at a specific orientation with respect to the storage compartment 80. For example, a second hinge may be connected to both apron 70 and the storage compartment 80 to limit the range of travel of apron 70. In some embodiments, apron 70 may be prevented from opening further than substantially parallel and planar with the bottom surface 84 of the storage compartment 80.

After the aprons 60 are attached to the rails 40, the rails 40 are installed on the playing surface 20 by aligning the rails 40 with the perimeter of the playing surface 20 and inserting the posts 59 of the rails 40 into the holes 29 in the playing surface 20. When assembled, the storage compartment 80 is directly connected to one or both of the playing surface 20 and a portion of the plurality of rails 40.

It should be noted that while, in the embodiments described above, the entire apron was movable between a first position in which the apron conceals the storage compartment and a second position in which the apron exposes the storage compartment, in other embodiments, only part of (but not the entire) apron is movable. For example, in the embodiment shown in FIG. 7, only the portion of the apron that covers the storage compartment can be made movable, with the other portions made fixed. For simplicity, the phrase "apron is movable between" is used herein and in the claims to refer to either the situation in which the entire apron is movable or the situation in which only a portion of the apron is movable. It should also be noted that while only one apron was shown as movable in the above examples, a billiard table can have multiple movable aprons. Further, while the storage compartment in the above examples was shown as positioned at least partially under both the rail and the playing surface, in other embodiments, the table can be designed such that the storage compartment is positioned only under the playing surface but not the rail or vice versa.

Additionally, it should be noted that an apron in the first position can conceal the storage compartment even though the apron is not in a fully-closed position. For example, the apron may be in a partially-closed position, in which there would be a gap large enough for the apron not to be considered fully closed but small enough that the apron would still conceal the storage compartment. Also, an apron in the second position "exposes the storage compartment" even when some, but not all, of the entire storage compartment is exposed (e.g., such as when the opening of the storage compartment is smaller than the width of the storage compartment). Further, while various specific mechanical connections were described herein, it should be understood that other types of connections can be used. For example, instead of the plurality of rails being mechanically connected directly to the playing surface, the plurality of rails 40 can be indirectly connected to the playing surface with an intermediate member, such as an apron. Accordingly, the connections were described herein should not be read into the claims unless explicitly recited therein.

It is intended that the foregoing detailed description be understood as an illustration of selected forms that the invention can take and not as a definition of the invention. It is only the following claims, including all equivalents, that are intended to define the scope of this invention. Finally, it should be noted that any aspect of any of the preferred embodiments described herein can be used alone or in combination with one another.

What is claimed is:

1. A billiard table comprising:

a playing surface;

a plurality of rails around a perimeter of the playing surface;

a storage compartment, wherein the storage compartment comprises a bracket that is received within a groove in one of the plurality of rails, and wherein the storage compartment provides a mechanical connection between the playing surface and the rail; and an apron movably connected to the storage compartment, wherein the apron is movable between a first position in which the apron conceals the storage compartment and a second position in which the apron exposes the storage compartment.

2. The billiard table of claim 1, wherein the storage compartment is configured to receive a plurality of billiard balls.

3. The billiard table of claim 1, wherein the apron is selectively retained in the first position by one or more of the following: a magnet, a detent and recess, and a latch.

4. The billiard table of claim 1, wherein an entirely of the apron is movable between the first and second positions.

5. The billiard table of claim 1, wherein only a portion of the apron is movable between the first and second positions.

6. A billiard table comprising:

a playing surface;

a plurality of rails around a perimeter of the playing surface;

a storage compartment configured to receive a plurality of billiard balls, wherein the storage compartment comprises a bracket that is received within a groove in one of the plurality of rails, and wherein the storage compartment provides a mechanical connection between the playing surface and the one of the plurality of rails; and an apron movably connected to the storage compartment, wherein the apron is movable between a first position in which the apron conceals the storage compartment and a second position in which the apron exposes the storage compartment.

7. The billiard table of claim 6, wherein the apron is selectively retained in the first position by one or more of the following: a magnet, a detent and recess, and a latch.

8. The billiard table of claim 1, wherein the storage compartment comprises a front edge, and wherein the apron is pivotably connected to the front edge.

9. The billiard table of claim 6, wherein the storage compartment comprises a front edge, and wherein the apron is pivotably connected to the front edge.

* * * * *